United States Patent [19]

Jürgens

[11] 4,187,061

[45] Feb. 5, 1980

[54] ROTARY HELICAL FLUID MOTOR WITH DEFORMABLE SLEEVE FOR DEEP DRILLING TOOL

[75] Inventor: Rainer Jürgens, Altencelle, Fed. Rep. of Germany

[73] Assignee: Christensen, Inc., Salt Lake City, Utah

[21] Appl. No.: 900,428

[22] Filed: Apr. 27, 1978

[30] Foreign Application Priority Data

May 5, 1977 [DE] Fed. Rep. of Germany ..... 2720130

[51] Int. Cl.[2] ..... F01C 1/10; F01C 5/02; F03C 3/00; E21B 3/12

[52] U.S. Cl. ..... 418/48; 418/153; 175/107

[58] Field of Search ..... 418/48, 153, 156; 175/107

[56] References Cited

U.S. PATENT DOCUMENTS

| | | | |
|---|---|---|---|
| 2,695,565 | 11/1954 | Seinfeld | 418/48 |
| 2,695,694 | 11/1954 | Seinfeld | 418/48 |
| 3,443,482 | 5/1969 | Lummus et al. | 418/48 |
| 3,453,772 | 4/1969 | Schlecht | 418/48 |
| 3,879,094 | 4/1975 | Tschirky et al. | 418/48 |
| 3,894,818 | 7/1975 | Tschirky | 418/48 |
| 3,938,744 | 2/1976 | Allen | 418/48 |

FOREIGN PATENT DOCUMENTS

| | | | |
|---|---|---|---|
| 2316127 | 10/1974 | Fed. Rep. of Germany | 418/48 |
| 569759 | 8/1977 | U.S.S.R. | 418/153 |

*Primary Examiner*—John J. Vrablik
*Attorney, Agent, or Firm*—Arthur A. Loiselle, Jr.

[57] ABSTRACT

A progressing cavity fluid motor for driving a drill bit for deep drilling tools is described. Such a motor is mounted on a drill string and is powered by a fluid such as drilling mud. The pump includes a housing, a stator with female helical threads within the housing and a rotor with male helical threads mounted inside of the stator. The drill bit is connected to the rotor. In the present invention the rotor has a threaded surface which is formed of an elastically deformable sleeve supported by a carrier shaft. The sleeve is mounted on the carrier shaft in such a manner as to prevent rotation between the two so that the sleeve drives the shaft by positive engagement between these two elements. Means are arranged for introducing a pressure inside of the elastically deformable sleeve for expanding the sleeve radially outwardly. This pressure is greater than the fluid pressure existing in the working cavity between the facing surfaces of the male and female threads and preferably changes as a function of the working pressure in the drilling mud.

17 Claims, 7 Drawing Figures

ROTARY HELICAL FLUID MOTOR WITH DEFORMABLE SLEEVE FOR DEEP DRILLING TOOL

BACKGROUND OF THE INVENTION

The invention relates to a progressing cavity fluid motor for directly driving a drill bit. Motors of this kind based on the Moineau principle find application to a considerable extent in deep drilling as direct drive bits or so-called "bottom motors". In these situations they are provided with an upper junction end on the housing for a connection with the drilling pipe. The motor drives the drill bit or similar drilling tool by way of a flexible shaft connecting the motor with the drilling tool. In this type of motor the flushing medium (drilling mud) is pumped downwards under high pressure into the progressing cavity work space in the motor between a stator forming the housing and the rotor forming the shaft. On its helical path through the motor a part of the pressure energy of the drilling mud is converted into rotational energy for the shaft. The pressure drop inside such motors, depending on the constructional design and direct drive drilling carried out in practice, is in the order of 25 or 60 bars.

With the well-known fluid motors the stator is in the form of a helical female thread and has an inner lining of an elastic deformable material secured to the housing. Inner linings of this kind are expensive to manufacture. For a satisfactory operation of the motor it is important that the molded helical thread surface in the working space be in contact with sufficient amount of the male helical rotor surface to seal against leakage. However excess pressure between the molded stator surface and the rotor results in increased wear of the molded surface and the performance of the motor drops; the design value of the motor will not be achieved. The determining contact pressure for the molded surfaces for an acceptable sealing in the contact areas of such fluid motors is usually determined so as to be in excess of a minimum; in so doing the pressure of the flushing medium is taken into account in the work space of the motor which tends to separate the motor surfaces from one another. In addition to pressure one must consider the temperature conditions under which a motor has to operate. This means that for the achievement of optimum operating conditions for the motor the latter must be adjusted for the existing operating conditions in the drill hole within narrow limits. This requires not only an expensive multiplicity of motors but also a most exact prognostication or predetermination of the drilling operating conditions in order to be able to prepare a suitable motor construction design. If the actual operating conditions deviate from the former which were established for the motor design either a loss of efficiency or increase in wear will occur.

With the aid of differential load measurements the contact pressures for the molded surfaces can be determined only within a limited extent with the result that with the help of such motors the torque capable of being generated is limited. While one can get by with relatively low torques with a single threaded helical motor chamber. With larger torque motors the helical shaped surfaces have a kind of a multiple thread interlacing gearing, that is the shafts for example have nine helical gears and the housings have ten screw threads. Such multiple designs however are often not sufficient to produce the necessary torque, in which cases integral drive parts are introduced in which several motors are connected in series coaxially. Integral drive parts of this kind, however, are not only extraordinarily large but also extraordinarily expensive and indeed not only in manufacturing but also in maintenance.

THE PRIOR ART

Typical Moineau type motors are shown in U.S. Pat. Nos. 3,894,818 and 3,879,094. An older patent showing a Moineau type motor having pressure equalization on the stator element is shown in J. L. Lummus et al U.S. Pat. No. 3,443,482. A similar U.S. patent to Schlecht U.S. Pat. No. 3,435,772 shows a radially compressible stator element in a Moineau pump. Seinfeld U.S. Pat. No. 2,695,565 illustrates a Moineau pump or motor wherein a stationary flexible diaphragm surrounds the rotor and the diaphragm is expandible outwardly against the stator; the diaphragm does not rotate with the rotor.

SUMMARY OF THE INVENTION

The refinement according to the present invention makes it possible to adapt the controlling equipment pressure between the areas existing in contact between the helically shaped surfaces at the pressure and temperature conditions of the drilling mud for sealing action and thus provide that under all operating conditions on the one hand the desired sealing is obtained and on the other hand a minimum amount of wear occurs. This is preferably achieved by providing a rotor with a threaded surface which is formed of an elastically deformable sleeve supported by a carrier shaft. Means are provided for preventing rotary motion between the elastically deformable sleeve and the carrier shaft. Means are arranged for introducing a pressure medium inside of the elastically deformable sleeve to provide a presssure for expanding the sleeve radially outwardly, this pressure being greater than the fluid pressure existing in the working cavity between the facing surfaces of the male and female threads. In the preferred embodiment the fluid pressure behind the deformable sleeve is changed as a function of the working pressure in the drilling mud. The appearances of wear are, in so doing, directly equalized by means of the elastic expansion of the deformable sleeve. The deformation of the sleeve is very precise and uniform with a simultaneous assurance of an efficient torque transmission between the sleeve body and its carrier shaft over the length and circumference of the sleeve. The practicable accommodation during the operation is assured in connection therewith not only by a running of the motor under optimum working conditions but also relieves the necessity of having a variety of types of motors of various designs in order to be able to make allowances in each case for operating requirements. With significantly reduced construction size and correspondingly lower costs, moreover, essentially higher efficiencies are achieved since already with a design with a single threaded screw gearing of stator and rotor pressure differences between inlet and outlet of the work space in the order of magnitude of 120 bars, and more, at high volumetric efficiency are achievable. With introduction of the motor according to the invention under normal drilling conditions, the motor can be constructed with a nine threaded screw gearing in a length of about 1 meter. In so doing such a drive delivers an essentially higher torque than conventional motors which for normal drilling conditions have a construction length of about 3 to 4 meters. The molded rotor body sleeve forms a relatively simple wear part which is easily replaceable.

DETAILED DESCRIPTION

Reference should be had to the following detailed description in conjunction with the drawings in which several non-limiting examples of the invention are further illustrated.

Figure 1:
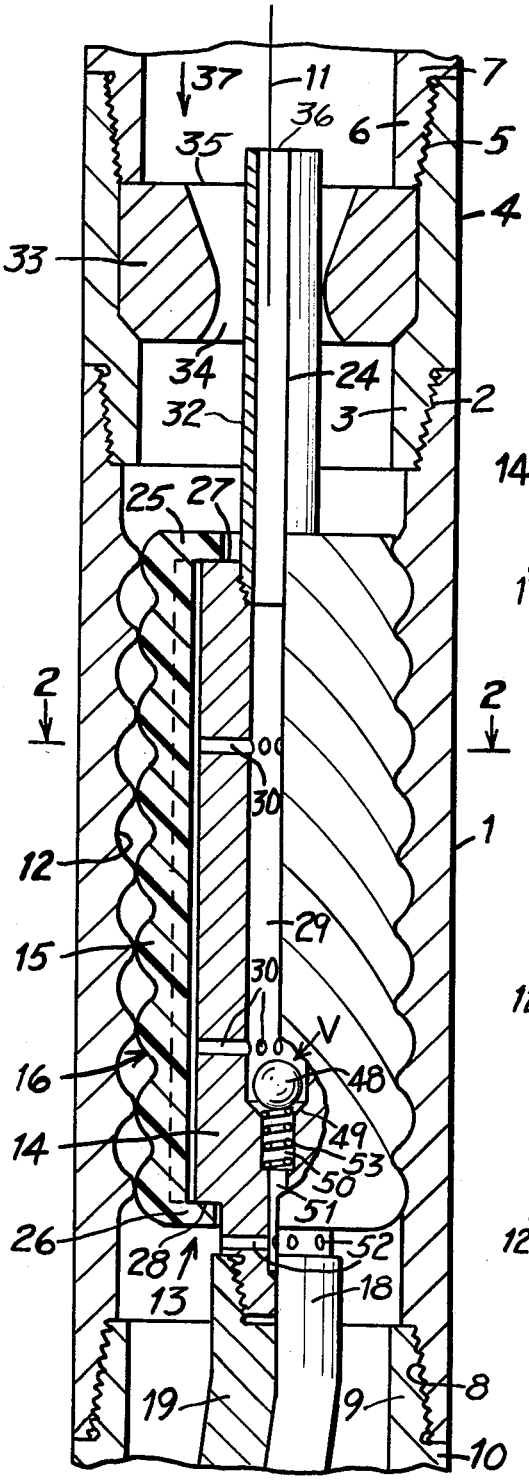
FIG. 1 is a fragmentary logitudinal cross section through an initial design of a fluid motor according to the invention with a rotor reproduced partly in section and partly as a side view.
Figure 2:
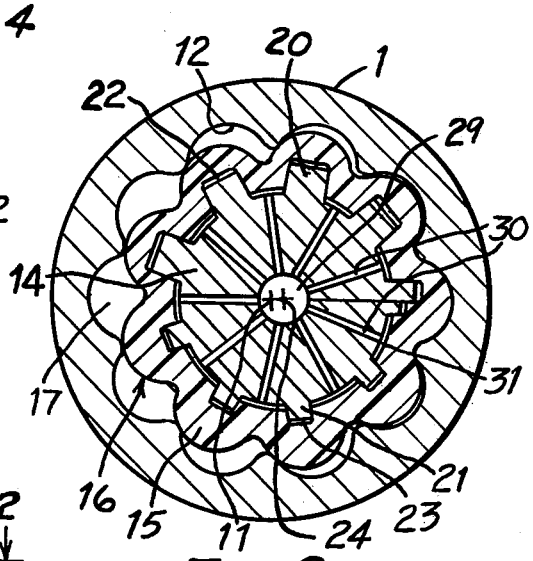
FIG. 2 is a section according to line 2—2 in FIG. 1 with various designs of the elastic sleeve on the carrier shaft above and below the medium plane.

The fluid motor illustrated in FIGS. 1 and 2 for a deep drilling motor comprises in particular an outside cylindrical housing 1 of for example stainless steel which on its upper inlet end has a conical inner thread 2 for a screw connection with an outside threaded attachment 3 of a tubular part 4. The latter on its part is provided in the upper region with a conical inner thread 5 for screw connection with a threaded attachment 6 on the lower end which forms the lower end of a pipe line for deep drilling. On its lower outlet end the housing 1 has a conical inner thread 8 for a screw connection with an attachment 9 provided with an outside thread of a tubular part 10 which receives any well-known or appropriate bushing arrangement. The parts 1, 4, 7 and 10 are arranged coaxially to a common longitudinal central axis 11.

On its inner side the housing 1 presents a female helical shaped surface 12 which is formed from the material of the housing and can be provided with a corrosion inhibitor for wear minimizing as well with a suitable surface coating. The specific shape of the helical surface is defined by means of screw threads left or right handed. In the example illustrated the helical surface is formed by a ten threaded screw thread. The housing constitutes a stator in the design illustrated. In housing 1 there is arranged a helical rotor which is rotatable and radially displaceable to a limited extent. The rotor as a whole is designated as 13 and consists of a carrier shaft 14 of steel or the like and a sleeve 15 of elastomer, for example rubber of polyurethane. The latter can in a given case be reenforced with glass fibers, metal filaments for example steel wire or the like.

Various modifications of sleeve construction are discussed in connection with FIGS. 5, 6 and 7.

The sleeve 15 has on its outside a helical surface 16 whose shape is synchronized to engage helical surface 12 of the housing 1. In the example illustrated the sleeve surface is composed of helical shaped threads which correspond to a nine threaded screw thread. It is obvious that the number of threads can be selected to fit desired design requirements. In addition, it is obvious that instead of the single stage of the helical screw thread course a two, or more, stage motor can be provided. The helical surfaces 12 and 16 intermesh in a kind of a screw gearing and mutually define a work space 17 which, in multi-threaded rotor-stator design, comprise a corresponding number of helical thread-shaped progressing cavities which serve to drive the motor.

On its lower side the rotor 13 is connected by joint 18 to an intermediate shaft 19 (whose lower end is not illustrated) which in turn is supported by a universal joint (not shown) or the like on a coaxially rotatable part mounted with bearings to a shaft to which the drilling tool can be connected. The intermediate shaft 19 forms the only axial support for the rotor 13 and permits the latter the necessary eccentric wobble movement for the function in operation.

The sleeve 15 of elastic material is supported on the center shaft or carrier 14 and is radially limited and displaceable. The shaft 14 in connection therewith is provided, on and along its outer side, with ribs 20 or 21 arranged and distributed over the circumference. The sleeve 15 is provided with corresponding flutes 22 or 23 or its inner side, the two being mutually in locking contact. Such a spline linkage assures nevertheless radial displacement motions of the sleeve 15 occurring in relation to its carrier 14 while providing a constant, uniformly distributed torque transmission to the exclusion of relative distortion movements to each other as well as to the uncontrolled deformations in individual areas or zones of the sleeve 15. The side surfaces of each rib and flute run parallel with each other so that with radial displacement movements of the sleeve 15 the snug surface contact between the ribs and the flute side walls is retained.

FIG. 2 illustrates in its upper half a type model of ribs 20 and flutes 22 which have a spiral shaped pattern around the shaft axis 24. The pattern of the flutes 22 in the sleeve is, is in connection therewith, adapted to the pattern of the screw threads. The lower half FIG. 2 illustrates a design in which the ribs 21 and the flutes 23 have a smaller radial dimension and accordingly can be arranged in a screw thread pattern to the shaft axis 24 which is independent from the pattern of the screw threads. The screw thread pattern assures a uniform take up of axial forces occurring between the sleeve and the carrier which must be taken up in a conceivable systematic axial pattern of ribs and flutes through separate means.

On its upper and lower ends the sleeve 15 is attached to the carrier 14 in an appropriate way by an inwardly projecting shoulder 25 or 26 with which it grips from behind sealing radial frontal surfaces 27 or 28 of the carrier 14. The carrier 14 is provided with an axial central hole 29 which is constructed as a passage way hole. A valve (V) is provided in the lower area of the central hole 20 which is described even further below. From the central hole 20 radial connecting channels 30 branch out which open out into the pressure spaces 31 between the ribs 20 or 21. These pressure spaces 31 between the sleeve 15 and its carrier 14 extend over the axial length of the sleeve 15 and terminate on the shoulders 25 or 26 and provide a pressure space extending around the carrier 14.

Since the central hole 20 is in open connection with the inlet area of the drive, the sleeve 15 in operation is directed radially outward by pressure in the working medium (drilling mud). This deformation force endeavors to expand the outside helical surface 16 of sleeve 15 and forces it against the helical surface 12 in the housing 1. The open connection between the central hole 29 to the working medium on the inlet side of the drive is made in the example according to FIGS. 1 and 2 by way of a coaxial pipe connection part 32 which acts effectively providing a restrictor at the inlet. This restrictor is formed in the example illustrated by an annular body 33 attached in the tubular part 4 having a central nozzle channel 34 by way of whose inlet plane 35 the end of the pipe connection part 32 is moved up to its inlet opening 36. Accordingly a higher pressure prevails on the back side of the sleeve 15 than is present in the working medium in the working space 17.

If now, for the driving of a drilling tool, a flushing medium is pumped downward through the pipe line, then a transient pressure increase occurs in the direction of the arrow 37 to the inlet end of the housing 1. First of all, as a result of the restrictors 33, 34, the working medium subsequently passing through the restrictors suffers a pressure drop before entering the work space 17. As the fluid flows through space 17 it imparts a rotary motion to rotor 13. As a result of admission of fluid on the inside of the sleeve 15 with the pressure derived from the work medium above the restrictors the helical surfaces 12 and 16 are held pressed together. This pressure introduced by the work medium, continually guarantees a dependable seal, and reduces to a minimum the wear occurring; and indeed is independent of it. In connection therewith the sleeve 15 is continually in a stressed condition.

Figure 3:
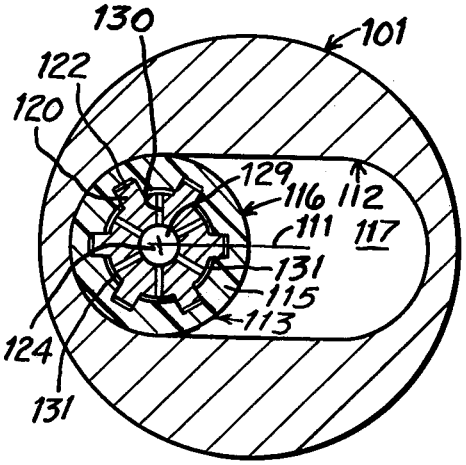
FIG. 3 is a section illustrated similar to FIG. 2 of an altered second design.

FIG. 3 shows a construction which corresponds in principle to that of FIGS. 1 and 2. For analogous construction parts thereof reference symbols are used only for similar parts by increasing the number by 100. In the difference in construction from FIGS. 1 and 2 the rotor 113 has the shape of a single threaded spiral with a corresponding spiral surface 116 which in each radial section has a circular cross section outline. This shape of the spiral surface 116 is appropriate to the spiral surface 112 in the housing 101 while maintaining the difference in the number of threads. The expansion of the sleeve 115 with a pressure derived from the work medium takes place in the ways already explained in FIGS. 1 and 2 or by a method further explained following in connection with FIG. 4. The valve (V) provided in the central passage hole 29 according to FIG. 1 has a ball valve 48 as a valve body. This ball valve 48 operates together with a valve seat which is formed by a conical reducer 49 of the central passage hole 20 to a coaxial continuation area 50 joining to the passage hole in the carrier 14. To the hole area 50 is connected coaxially a reduced hole area 51 once again in cross section which in the region of its sealed end is connected by way of radial channels 52 with the outlet side of the drive beneath the work space 17 FIG. 1.

In the hole area 50 a spiral pressure spring 53 is provided on which the ball valve 48 is supported on the upper side. The spiral pressure spring 53 is adjusted in such a way that the ball valve 48 only arrives in contact with it valve seat 49 if the pressure difference between upper side and lower side of the ball valve exceeds a desired predetermined amount. By this means the beginning of a closing of the central hole 29 can be made for a flow from the inlet to the outlet side of the drive dependent upon the building of a pressure difference. This is made possible after disconnecting the drive by means of stopping a downward pumping of flushing medium to draw up the drive together with the drilling tube line while the flushing medium in the drilling tube line can run down freely below. At the same time the presence of the valve (V) makes possible a lowering of the motor into a drill hole with flushing in an opposite direction.

Figure 4:
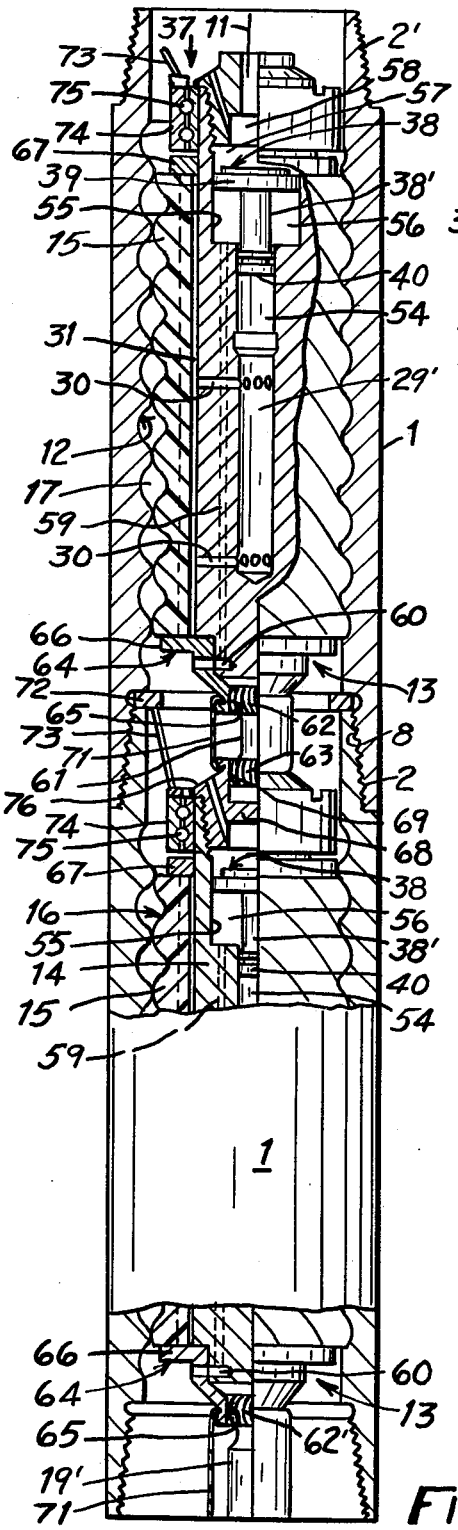
FIG. 4 is an illustration similar to FIG. 1 of another design with two collective drive units arranged in tandem.

FIG. 4 illustrates a construction corresponding to FIGS. 1 and 2 in which in place of a direct connection of the pressure space between sleeve 15 and carrier 14 with the work medium on the inlet side of the drive, the latter is preferably constructed as a sealed chamber and is filled with a separate pressure medium. A piston 38 which is impinged on by the work medium pressure acts as an equalizing piston and pressure transmitter to the separate pressure medium. This piston 38 is formed as a differential piston and has a piston part 30 with a larger surface and a piston part 40 with a smaller pressure surface; accordingly this piston forms a pressure multiplier. Instead of a piston a membrane can be used, not only in a pressure multiplying but also in a construction having a direct pressure derivation without multiplication.

The hole pocket 29 forms in its upper area a cylinder space 54 to which is joined a cylinder hole 55 having an enlarged diameter. Within the cylinder holes or spaces 54, 55 the differential pistons 38 interwork, the upper piston part 39 being contained in the cylinder hole 55 and the lower piston part 40 being contained in the cylinder hole 54. The upper side of the upper piston part 39 is turned in the direction of the arrow 37 to the flowing work medium and is impinged by the pressure from the latter on the basis of the presence of an inlet opening 58. This inlet opening 58 makes a connection to an upper cylinder chamber 57.

Below the upper piston part 39 in the cylinder hole 55 is a lower cylinder chamber 56. The cylinder chamber 56 is connected now by way of an axial connecting channel, as well as by way of any one connecting channels 59 radially adjoined to connecting channel 60 with the outlet side of the drive. Correspondingly a pressure prevails in cylinder chamber 56 which is equal in pressure to that in the working medium on the outlet side of the drive. Correspondingly the upper piston part 39 an essentially higher pressure difference is displayed which moreover is still dependent on pressure reduction in the drive and changes with the latter. This means that the pressure impingment of the form body in the sense of expansion is adjusted according to the performance of the drive, that is to each moment of delivered torque of the operation.

In place of the differential piston it is also conceivable to provide a piston without gradation in cases in which a pressure multiplication is not required. In addition it is conceivable in place of the piston to install a membrane. In place of a membrane or a membrane combination a bellows combination can also find application and indeed not only in refinement with but also in a refinement without multiplication.

FIG. 4 illustrates a drive which is constructed of two drive units which are connected in a series in so doing each drive unit corresponds in the basic construction described above.

The two rotors 13 of the drive units are jointed beneath each other by means of a kind of universal joint for assurance of synchronous rotational movements so that without this connection the radial displacements of the individual rotors inside their connected housings 1 are not prevented. For joining of the two housings 1 the latter are equipped in each case at their upper inlet ends with a conical attachment provided with outer threads 2' while they are provided on the outlet side unchanged ends with a conical inner thread 8.

The universal joint for the shaft connection consists in particular of an intermediate shaft 61 which on its upper and lower ends is provided in each case with a slightly convex shaped outer gearing 62 or 63. On the lower end of the rotor 13 of the upper drive unit a firmly attached clutch coupling box 64 is mounted to the shaft which has an inner gearing 65 below the salient area which with the upper slightly convex outer gearing 62 of the intermediate shaft 61 interacts. Also on the lower end of the shaft 13 of the lower drive unit such a clutch coupling box 64 is attached whose gearing 65 interacts with a slightly convexed outer gearing 62' to an intermediate shaft 19' which performs the function of the intermediate shaft 19 explained in connection with FIG. 1.

Figure 6:
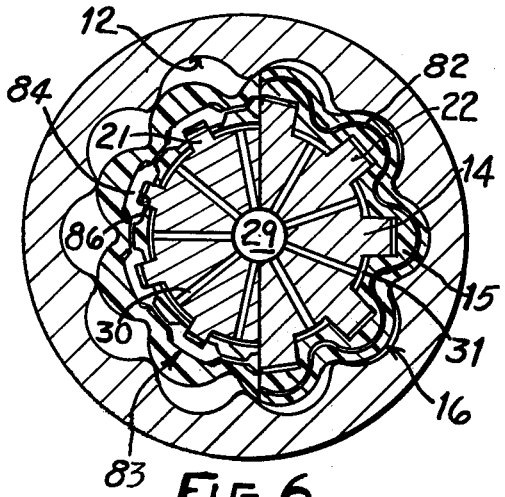

The clutch coupling boxes 64 have a radial flange area 66 which performs the function of the shoulder 26 of the sleeve 15 in construction according to FIG. 1 or 6. Correspondingly the flange 66 joins the pressure space 31 touching and sealing to the lower end of the sleeve 15 in so doing the flange 66 at the same time fulfills even the function of an axial pressure take up.

In place of the above shoulder 25 of the sleeve 15 according to FIG. 1 on each upper end of the rotor 13 a flange ring 67 is provided for the sealing of the pressure space 31 which performs the function of flange 66 at this spot.

The rotor 13 of the lower drive unit is provided on its upper end on its part with its firmly joined clutch coupling box 68 which in an upper broadened hole area is inserted in the shaft. This clutch coupling box 68 has an inner gearing 69 which is in contact with the slightly convex lower outer gearing 63 of the intermediate shaft 61. Connecting channels 70 are made through the clutch coupling box 68 making a connection between work medium in the outlet area to the drive unit and to the cylinder space 57 above the upper piston part 39 of the pressure transmission piston.

The gearing between the intermediate shaft 61 and the clutch coupling box 64, 68 can run in the work medium. In the construction illustrated however they run sealed in a bellows of an elastic pipe body or the like 71 and a space filled with lubricant in order to reduce wear.

Such a casing is also provided in the connection area between the clutch coupling box 64 and the intermediate shaft 19'.

The rotor 13 also of the above drive unit has on its upper end in each case a clutch coupling box 68 as was described previously, if it is planned to join the above drive unit illustrated in FIG. 4 on the upper side with additional drive units in a modular way. For the case that this is not provided, in place of the clutch coupling box 68 illustrated, another inserted construction part can be provided which takes over the additional function further described below of a bearing support.

In two or more drive units connected in series in the manner illustrated in FIG. 4 axial forces occur which can indeed be taken up basically jointly by a support as it was mentioned in connection with FIG. 1. For distribution of the axial forces and at the same time for specific axial location of the rotor 13, it is however advantageous to provide these rotors in each case with an axial bearing on the upper side of the drive units connected in series. In the construction according to FIG. 4 this axial bearing consists in particular of a support ring 72 screwed on between it and the housing 1 and defined in this way that on the under side two or more flexible guide rods 73 engage.

On their bottom ends these guide rods 73 are flexibly joined with an outside spacer 74 which correspondingly floats that is is suspended displaceable in a radial direction. This outer spacer 74 surrounds the upper end area of the carrier 14 and contains at least one axial bearing 75. In the type model illustrated two axial bearings are arranged over each other by which the lower inwards projecting shoulder of the spacer 74 is supported. The upper axial bearing 75 is overlapped by an outward projecting shoulder 76 of the clutch coupling box 68 so that the bearings 75 defined between the spacer 74 and the carrier 14 of the shaft 13 are supported. A corresponding bearing is also found on the upper end of the rotor 13 of the upper drive unit although there the representation on a schematic view of the guide rod 73 for the support of the spacer 74 is limited. The foregoing described axial bearings ensure the cited specific axial bearing of the shaft 13 of the drive units, in so doing length changes or axial displacements which result from temperature expansions and bearing wear inside the gearing between the intermediate shafts 61, 19' and the clutch coupling boxes interacting with the latter are taken up.

The axial bearings are illustrated in the working medium, they can however also be enclosed by a suitable medium and then operate wear protected in a special lubricant.

According to the performance of the drive or of a drive unit it can be necessary by way of the above mentioned sheathing of the elastomer material of the sleeve 15 to provide the sleeve 15 with reenforcement in order to transfer to the latter for take up of the loads in the bearing.

Figure 5:
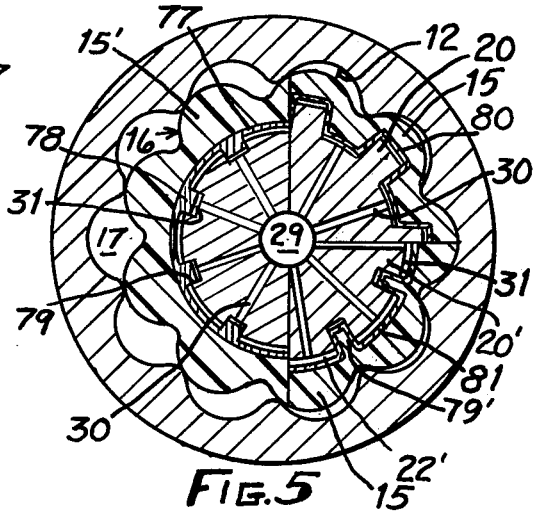
FIGS. 5 and 6 are sectional illustrations similar to FIG. 2 of various different expandible sleeves.

FIG. 5 shows (in the left-hand side) a first construction of a reenforcement or sheathing which consists of a metallic cylindrical tube bushing 77. On this tube bushing 77 is cemented or vulcanized on the outside of the sleeve 15' which offers in its turn a corresponding cylindrical inner surface and itself is not ribbed or fluted. The pressure space 31 for the take up of the pressure medium is correspondingly accomplished on the inner side of the tube bushing 77 which with pressure impingement together with the sleeve 15' performs a radial expansion movement. On its inner side the tube bushing 77 has welded on or in otherwise appropriate ways attached ribs 78 which interact with the flutes 79 in the carrier body 14. Between the bottoms of the flutes 79 and the inner side of the frontal surfaces of the ribs 78 are left slit shapes intermediate spaces 31 which by way of individual connecting channels not illustrated are connected with the pressure space 31 and form a component of this pressure space. The ribs 78 and flutes 79 preferably run screw threaded on the bases for the take up of axial forces. They can, however, also be arranged concentrically.

The improvement according to FIG. 5 assumes a significant expansion capability for the tube backing 77 which may not be accommodatable, in all cases, in the elastic region. The construction according to the right-hand side of FIG. 5 shows a reenforcement in the form of an inner lining 80 which is adjusted to the flute profile of the inner side of the sleeve 15. The inner lining 80 correspondingly has a nearly dentiform cross sectional profile. In this arrangement the sleeve 15 is cemented onto or vulcanized onto the inner lining 80. Also the inner lining 80 consists of metal, however, here an outwardly directed expansion deformation is not made possible by means of tangential expansion as in the construction according to the left side of FIG. 5 but rather by a bending deformation of the inner lining 80. In the flutes 22 covered by the inner lining 80 of the sleeve 15 the ribs 20 of the carrier body 14 interlock like that illustrated in principle in the upper half of FIG. 2 and in connection with it has been described.

While in the constructions according to FIG. 5 a direct contact between the elastomer material of the sleeve and the metallic material of the carrier 14 is completely eliminated, the construction illustrated in the right side of FIG. 6 provides that in the sleeve 15 a reenforcement 82 is imbedded which essentially follows in its cross section pattern form the helical surface 16 of the sleeve 15. The reenforcement 82 can have a corresponding corrugated spiral shape which extends in the sleeve continuously around the shaft over the length of it. The reenforcement can also be formed by a plurality of imbedded, corrugated ring bodies spaced along the sleeve. Finally it is also conceivable to construct the reenforcement 82 for example in the form of a perforated corrugated tube which is vulcanized on or cast on in the sleeve 15. Also constructions in the form of a hose of fabric, weave, pleat, string or the like are conceivable in which in addition to textile material glass fibers or metal filaments come into consideration for reenforcements of this kind.

Figure 7:
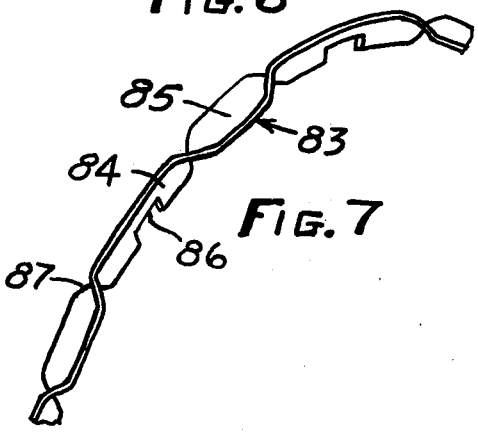
FIG. 7 is a detail of a reinforcing element of FIG. 6.

The construction of the reenforcement according to the left side of FIG. 6 consists of metallic rings 83 whose approximate shape can be inferred in particular from FIG. 7 which illustrate in perspective representation a section of such a ring.

The rings 83 arranged radially spaced and superimposed imbedded in the elastomer material of the sleeve 15 and comprise the limited areas 84 and 85 by each other by which the regions 85 have a coaxial surface alignment to the axis of the regions 84 and a radial alignment. In the regions 84 flute shaped clearances 86 are provided bordering on the inner edge which are intended for a direct gearing contact with the ribs 21 of the carrier 14, as was already described above in connection with the lower half of FIG. 2. Correspondingly the main power transmission takes place in the peripheral direction of the ribs 21 on the regions 84 of the rings 83 from avoidance of a noteworthy power transmission by the ribs 21 on the elastomer material of the sleeve 15. The limited transmission area 87 situated between the areas 84, 85 of the rings in each case offers the possibility of an elastic deformation of the rings in the sense of an expansion if in the material for reenforcement of this kind glass fibers or metal filaments are taken into consideration.

While the invention was described as a motor for the direct drive of drill bits it is obvious that motors according to the invention are not limited to such a preferred application area but can be applied in other application areas in which analogous operating conditions are present. Also an application applying pumps under analogous conditions is conceivable. Also applications to temporary forms are conceivable in which housing and shaft revolve with a variable rate of speed even if rectified. A conceivable application case for this is for example the introduction of one of the described constructions as a direct drive drill bit on the lower end of a moving drill casing line turning on its part. In addition to the aforesaid applications described in detail as a direct drive drill bit the drive can also basically be employed for all rotary drive tasks as they are required in a given case in a drill hole or drill tube.

In a reversal of the type model illustrated it is also conceivable for special cases to allow the housing 1 to operate as a rotor and the shaft as a stator without fundamental change of the construction form illustrated in which case the bit or otherwise would be connected to a driving tool to the housing and the shaft after extension out over the housing with the bore rods or the like.

What is claimed is:

1. In a progressing cavity fluid motor for driving a drill bit for deep drilling tools adapted to be mounted on a drill string and powered by a fluid such as drilling mud, said motor including a housing, a first driving surface with female helical threads mounted within and secured to the housing, a second driving surface with male threads inserted within the first driving surface, said surfaces being mounted for relative rotation, one of said surfaces being arranged to be connected to rotate a drill bit, the improvement wherein the second driving surface is formed of an elastically deformable sleeve supported by a carrier shaft, means for preventing rotary motion between said elastically deformable sleeve and the carrier shaft, and means for introducing a pressure medium inside of the elastically deformable sleeve to provide a pressure for expanding said sleeve radially outwardly, said pressure being greater than the fluid pressure existing in the working cavity between the facing surfaces of the male and female threads.

2. In a progressing cavity fluid motor for driving a drill bit for deep drilling tools adapted to be mounted on a drill string and powered by a fluid such as drilling mud, said motor including a housing, a stator with female helical threads within the housing, a rotor with male helical threads inserted within the stator and mounted to rotate a drill bit, the improvement wherein the rotor has a threaded surface which is formed of an elastically deformable sleeve supported by a carrier shaft, means for preventing rotary movement between said elastically deformable sleeve and the carrier shaft, and means for introducing a pressure medium inside of the elastically deformable sleeve to provide a pressure for expanding said sleeve radially outwardly, said pressure being greater than the fluid pressure existing in the working cavity between the facing surfaces of the male and female threads.

3. A motor according to claim 2 wherein the means for preventing rotary movement between the sleeve and the carrier shaft comprises interengaging flutes and ribs on the sleeve and shaft.

4. A motor according to claim 2 wherein the means for preventing rotary movement between the sleeve and the carrier shaft comprises interengaging threads on the sleeve and shaft.

5. A motor according to claim 2 wherein the sleeve is reinforced by a reinforcing member bonded thereto.

6. A motor according to claim 5 wherein the reinforcing member is a tube supporting the sleeve.

7. A motor according to claim 5 wherein the reinforcing member is imbedded in the sleeve.

8. A motor according to claim 5 wherein the reinforcing member is imbedded in the sleeve and has a pattern essentially conforming to the helical surface of the sleeve.

9. A motor according to claim 2 wherein said pressure introducing means includes channel means communicating with an area at the high fluid pressure side of the motor.

10. A motor according to claim 9 wherein a restrictor is provided above the motor to create a fluid pressure drop at the entrance to the motor and the channel means communicates with the high pressure side of the restrictor.

11. A motor according to claim 9 wherein a plurality of radial channels distribute the pressure medium to the inside of the sleeve.

12. A motor according to claim 9 having a bypass valve in the channel means.

13. A motor according to claim 9 wherein the channel means includes a pressure multiplying means.

14. A motor according to claim 9 wherein the channel means includes movable means for transmitting high pressure to a fluid in the channel means.

15. A motor according to claim 2 wherein it is connected in series to another similar motor.

16. A multi-motor arrangement of claim 15 wherein each motor rotor is supported by means of a separate axial bearing.

17. A motor according to claim 16 in which the axial bearings are displaceable in a radial direction.

* * * * *